US005941629A

United States Patent [19]

Tuscher

[11] Patent Number: 5,941,629

[45] Date of Patent: Aug. 24, 1999

[54] COMBINED FLASHLIGHT AND SELF-DEFENSE SPRAY DEVICE

[76] Inventor: Adolf Tuscher, Rathausplatz 3/II, Ingolstadt D-85049, Germany

[21] Appl. No.: 08/849,898

[22] PCT Filed: Jan. 26, 1995

[86] PCT No.: PCT/EP95/00279

§ 371 Date: Sep. 16, 1997

§ 102(e) Date: Sep. 16, 1997

[87] PCT Pub. No.: WO96/19710

PCT Pub. Date: Jun. 27, 1996

[30] Foreign Application Priority Data

Dec. 22, 1994 [DE] Germany ..... 44 45 987

[51] Int. Cl.[6] ..... F21L 7/00

[52] U.S. Cl. ..... 362/253; 362/202; 362/119; 362/96; 222/113; 222/192

[58] Field of Search ..... 362/253, 202, 362/205, 109, 119, 120, 96; 222/113, 192

[56] References Cited

U.S. PATENT DOCUMENTS

| | | | |
|---|---|---|---|
| 2,625,764 | 1/1953 | O'Brian . | |
| 3,716,170 | 2/1973 | Magels . | |
| 3,776,429 | 12/1973 | DeLucia | 222/162 |
| 4,186,851 | 2/1980 | Cantor . | |
| 4,223,804 | 9/1980 | Morris et al. . | |
| 4,434,914 | 3/1984 | Meshberg | 222/153 |
| 5,086,377 | 2/1992 | Roberts . | |
| 5,331,523 | 7/1994 | Delzer | 362/96 |
| 5,373,427 | 12/1994 | McLean | 362/96 |
| 5,420,766 | 5/1995 | Hollis | 362/253 |
| 5,549,220 | 8/1996 | Whalen | 222/1 |
| 5,575,555 | 11/1996 | Chang | 362/109 |

FOREIGN PATENT DOCUMENTS

| | | |
|---|---|---|
| 0077945A1 | 10/1992 | European Pat. Off. . |
| GM 79 09 006U1 | 3/1979 | Germany . |

*Primary Examiner*—Laura K. Tso
*Attorney, Agent, or Firm*—William D. Lee, Jr.; Cort Flint

[57] ABSTRACT

The invention pertains to a manually operated self-defense device with a battery operated flashlight instrument and a spray device for a self-defense spray. The device comprises two connected housing parts (2, 13). The first housing part (2) contains the lighting instrument. The second housing part (13) contains a compartment into which a spray can (14) is inserted; this spray can compartment has a spray opening (19) and an actuating opening (20). With this arrangement the lighting instrument and the spray device complement and support each other to provide an effective defense.

13 Claims, 3 Drawing Sheets

COMBINED FLASHLIGHT AND SELF-DEFENSE SPRAY DEVICE

FIELD OF THE INVENTION

The present invention relates to a manually operated self-defense device, specifically to a novel combination of a flashlight and irritating spray device.

BACKGROUND OF THE INVENTION

Due to the rise in crime and violence people are in danger of being attacked, especially at night. A simple protection consists in a flashlight by means of which an attacker can be seen and possibly identified quickly at night. Flashlights are therefore regularly carried by safety units such as police, security personnel etc.

Also known are spray cans with irritating gases, e.g. tear gas, pepper sprays, etc., which can be aimed and sprayed at an attacker. These irritating gases are designed to incapacitate an attacker for at least a certain period of time. The sprayed irritating substances usually act intensively on the eyes, so that an attacker's sight is substantially affected. To obtain a sufficiently strong effect it is necessary for the spray to reach open eyes.

A manually operated self-defense device combining a light and a spray device in one unit is already known. Such a device is marketed under the designation: "Irritating gas and light pistol TW 1000 Flash Light". This device is in form of a pistol, with the light and spray mechanism being at the muzzle of an imitation pistol barrel, whereby the direction of the spray and of the light beam corresponds to the direction of the barrel. An On/Off switch for the light portion is located in the back of the handle. The actuating lever of the spray mechanism has the aspect and position of a pistol trigger. Furthermore an adjustable safety button for the actuating lever of the spray mechanism is located below on the pistol handle. Special cartridges are required for the irritating spray gas to be inserted into the pistol handle. This combination of light and spray mechanism has the disadvantage that an attacker is warned in advance by the highly visible pistol shape. It is also possible that when mistaking the device for a fire arm, an attacker may be tempted to overreact to the disadvantage of the person defending himself.

It is considered to be a further disadvantage that the spray direction and the direction of the light beam are identical. When the irritating gas pistol is aimed at the face of an attacker he closes his eyes under the blinding effect so that the effectiveness of the irritating gas sprayed is much reduced at the same time and is therefore insufficient for an effective defense.

Another disadvantage is the complicated handling. The gas cartridge can only be inserted, and the connection to the actuating lever on the device can only be effected by means of a tool and with the addition of a drop of oil, and additional adjustments are necessary for a trouble-free operation. If a gas cartridge has not been inserted very carefully, the danger is created that the spray mechanism may not function when needed. Furthermore, the actuation itself is complicated and can lead to confusion in the excitement of an attack. Since the light switch is actuated with the thumb, and the actuating element as well as the safety button for the spray mechanism are actuated with the index finger of the same hand and with the same hand position, errors in operation may occur. Furthermore, the force required to actuate the light switch at the back of the pistol handle is applied on the other side of the handle in the opposite direction of the actuating element of the spray device (and vice versa), so that in the hectic moment of an attack errors in operation and unintentional spraying may occur as a result.

The flash light and the spray device are permanently combined so that the two mechanisms cannot be separated from each other and be used separately if need be. Furthermore, flash lights with the conventional cylindrical form are known, with a light head, a cylindrical central tubular element to hold the batteries, and a screw cap at the end. For selective utilization of many different batteries in adaptation to a desired light beam length, it is a known method to make the central tube in several parts and to connect the individual parts to each other as needed by means of threads.

It is the object of the present invention to further develop a self-defense device of the type mentioned above so that operation is improved while structure remains simple and functioning reliable. This object is attained through the characteristics of claim 1.

SUMMARY OF THE INVENTION

According to claim 1 the light beam projector in form of a cylindrical flash light housing is located in a first housing part, with a reflector at the forward end, providing light rays projected in axial direction, with a light switch on the mantle surface of the cylinder, and with a cylindrical battery compartment. A second housing part is used as a cap at the end opposite to the reflector, and is connected with the first housing part in such manner that it can be removed. The second housing part has a holder to receive and attach a helicoidal spring serving as a compression spring and mass connection. Furthermore, the second housing part contains the spray can compartment for the insertion of a spray can. At least two openings to the outside are provided on the spray can compartment, whereby a first opening is a spray opening near a spray nozzle located on the spray can. A second opening is provided as an actuating opening through which it is possible to reach the actuating element of the spray can.

This device can be produced easily and at low cost, whereby the second housing part can be retrofitted with appropriate adaptation as an accessory of a normal flashlight such as available on the market. Errors in operation are practically excluded due to the position and arrangement of the actuating elements. The device can be given the overall aspect of a flash light, so that an attacker will have no visual indication of the additional self-defense device present, and will thus be deceived. There will be no association with a dangerous fire arm, so that an attackers will not be provoked at an early stage into a dangerous over-reaction. The insertion of commercially available spray cans is simple and can be effected without tools.

An especially advantageous embodiment is obtained with the characteristics of claim 2, in that the second housing part is also cylindrical and has approximately the same diameter as the first housing part, so that an overall cylindrical housing is provided. This creates the visual impression of a normal flash light. In addition, the device can be carried and used as a normal flash light when no self-defense situation exists. A commercially available spray can containing self-defense gas is here inserted in axial direction into the second housing part. The spray opening and/or the actuation opening are on the surface of the cylinder wall so that the direction of spray and/or the direction to reach inside are approximately perpendicular to the housing axis. This makes easy operation of the spray can possible by reaching in through the surface of the cylinder wall.

On the other hand, the advantage exists here that the direction of spray is offset by 90° from the direction of the light beam. In case of an attack, the approaching attacker is generally illuminated by a light beam directed at his face. In order to spray, the device must be then pivoted by 90°. Since at that moment the blinding effect on the attacker is eliminated, he will automatically open his eyes wide so as to seize up a situation which has now changed for him. The effect of the gas is now strongest, as the spray enters the attackers wide open eyes.

According to claim 3 the spray opening and the actuating opening are approximately across from each other on the surface of the cylinder wall, and are offset relative to the longitudinal center of the second housing part. With a matching design of the end connection, the second housing part can be connected either in such manner that the spray opening is closer to the end of the device, or more in the center of the device. This can be adapted during assembly as the user desires. The spraying device is then actuated accordingly, with the light beam directed up or down.

According to claim 4 the actuation opening is sized so that the spray nozzle can easily be reached through it. With this type of position and actuation, an accidental actuation of the spray device or spraying oneself is excluded.

Although it is already impossible to commit an actuating error, since it is necessary to reach inside for the spray can it may be necessary, depending on the circumstances indicated in claim 5, to provide the actuating opening and/or the spray opening with a sliding cover. This could be, for example, a sliding cover ring for both openings.

According to claim 6, all authorized commercially available irritating gases, in particular tear gas or a pepper spray can be used as self-defense sprays. According to claim 7 the second housing consists of a tubular part and of an adapter part, whereby the adapter part is provided on the one hand with the holder with the helicoidal spring and the detachable connection to the first housing part, and on the other hand comprises a detachable connection to the tubular part. The adapter part according to claim 8 which is also of a cylindrical design corresponding to the other housing parts, is preferred. It is furthermore advantageous according to claim 9 to provide a locking arrangement on the second housing part identical to the one on the first housing part, and furthermore to establish the connection immediately according to claim 10.

Thus, the above characteristics serve to obtain a set of modules by means of which a commercially available flash light can be easily equipped to be a self-defense device. For this it is merely necessary to unscrew the screw cap of the flash light and to remove the helicoidal spring. The helicoidal spring is then inserted into the adapter part and the latter, instead of the screw cap, is screwed on the body of the flash light. The tubular part with the inserted spray can is then screwed on to the adapter part, and is again closed at its end by means of the screw cap. The tubular part can then be screwed on so as to be pivoted by 180° depending on the desired actuation. Instead of the threaded connection of claim 11, known connecting techniques such as snap-on locks, bayonet locks etc. are also possible as alternatives.

According to claim 12 it is here a known advantage to keep a spare bulb in the interior space of the helicoidal spring, in particular embedded in a foamed material, and to keep it available. In a further development according to claim 13, a rubber bushing is proposed as an elastic support and seal between at least a partial area of the spray can and the surrounding wall of the spray can compartment.

DESCRIPTION OF THE DRAWINGS

The invention is explained in further detail through an example of an embodiment showing additional details, characteristics and advantages.

DETAILED DESCRIPTION

Figure 1:
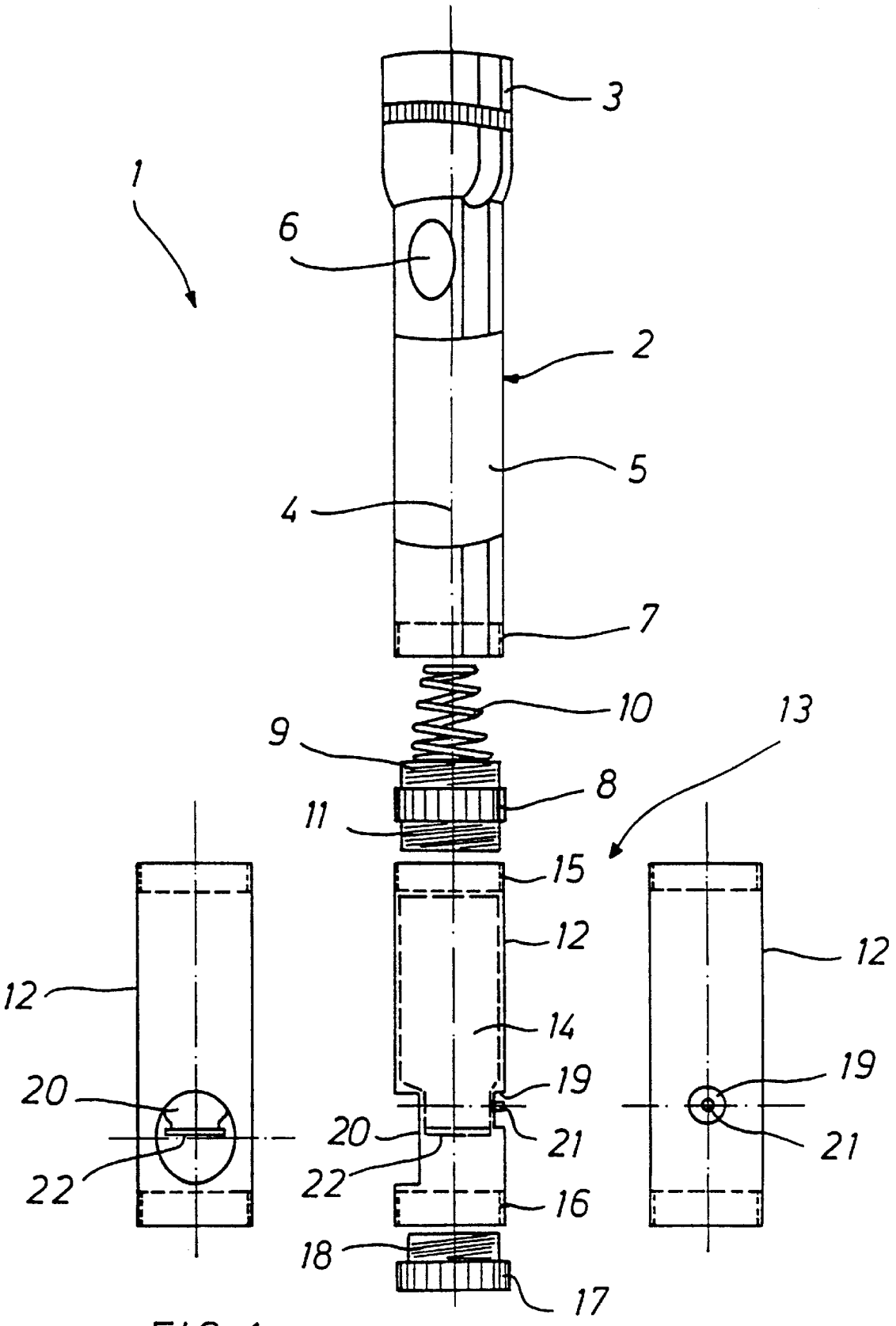
FIG. 1 shows a manually operated self-defense device before assembly, with a tubular part, in three views.

The self-defense device 1 shown in FIG. 1 consists of a first housing part 2 in form of a cylindrical flash light housing with a lamp head 3. In the latter a reflector and a lamp of a light projector (not shown) are located, with the light beam being directed in the direction of the axis of housing 4.

The first housing 2 furthermore contains in its hollow cylinder a cylindrical battery compartment 5 to receive several cylindrical batteries one behind the other (not shown). On the outside of the housing a known electrical sliding switch 6 is provided to turn the light beam on and off.

At the rear end of the housing part 2 are inside threads 7 into which a matching cylindrical adapter part 8 with an appertaining threaded connection piece 9 can be screwed. The threaded connection piece 9 is made so that it can contain a helicoidal spring 10 which is a known mass and compression spring establishing the mass connection of the electrical circuit for the light projector when the batteries are inserted and the adapter part 8 is screwed in.

The adapter part 8 and a tubular part 12 which can be screwed on via an additional identical threaded connection piece 11 together constitute a second housing part 13 to receive and hold a cylindrical spray can 14 (drawn in broken lines) which can then be actuated.

Figure 3:
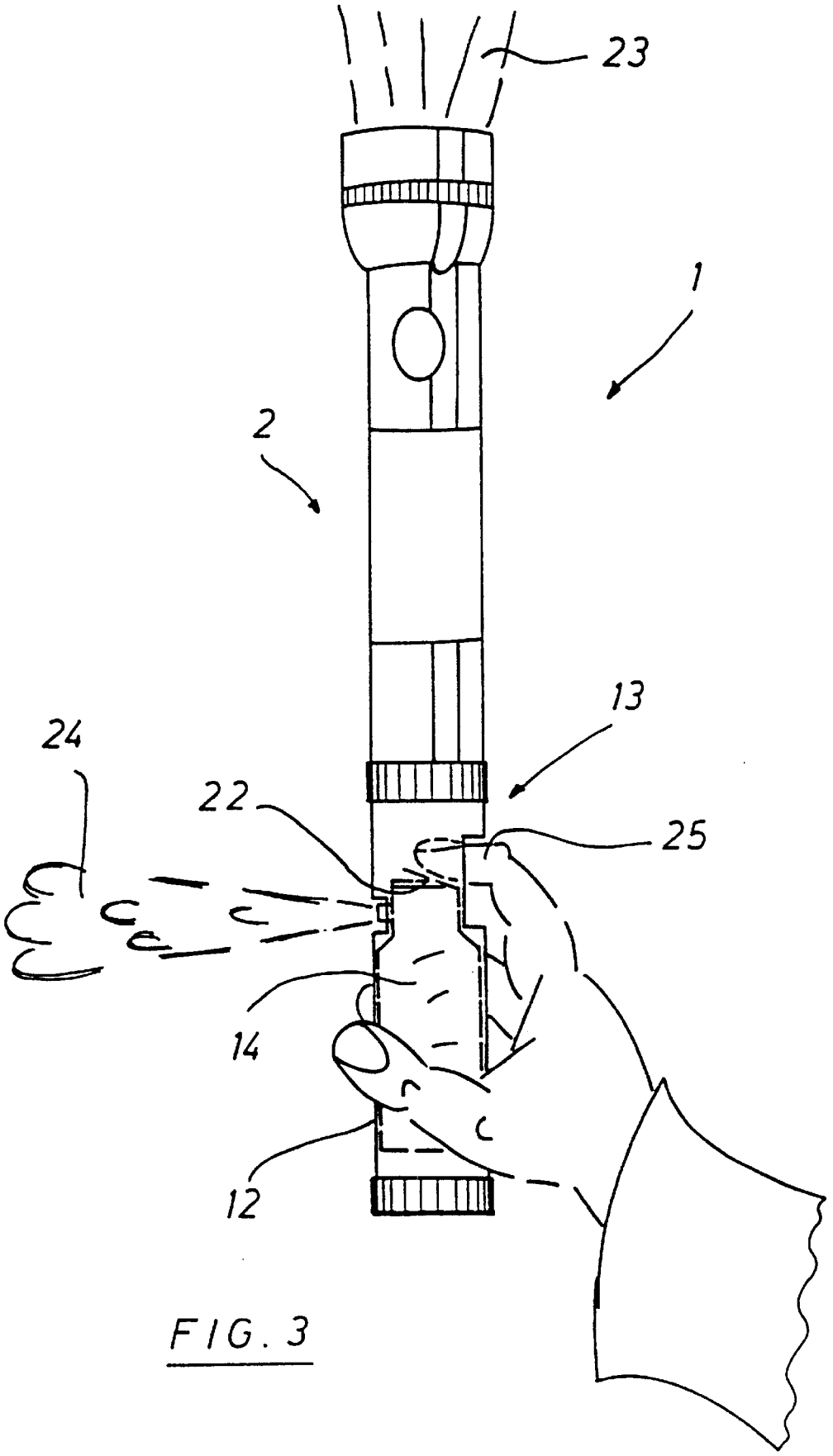

The tubular part 12 is cylindrical and has the same diameter as the cylindrical flash light housing. The tubular part 12 is provided with identical internal threads 15, 16 at both ends, matching the inside threads 7 on the first housing part 2. With this arrangement the tubular part 12 with the adaptor part 8 in the arrangement shown in either FIG. 1 or FIG. 3 can be pivoted by 180° and be connected as shown in FIG. 3. A screw cap 17 is provided with a threaded connection piece 18 which can be screwed into all the existing inside threads 7, 15, 16.

In the three views of the tubular part 12, each of which is rotated by 90° in FIG. 3, the position and configuration of a spray opening 19 and a larger actuating reach-through opening 20 can be seen. The spray opening 19 and the actuating opening 20 are across from each other and are offset relative to the longitudinal center of the tubular part 12. This is due to the position of the spray nozzle 21 and of the actuating element of the inserted spray can 14. The direction of spray and direction of action upon the actuating element 22, perpendicularly to the housing axis 4 can be seen here.

When the screw cap 17 into which the helicoidal spring 19 can be inserted in exactly the same manner as in the adapter part 8 is placed as a closure on the first housing part 2, this creates a separate conventional flash light without spraying mechanism. Correspondingly, by placing the adapter part 8 (without helicoidal spring 10) and the screw cap 17 on the tubular part 12, the spraying mechanism which thus becomes functional can be used separately and without the lighting part.

Figure 2:
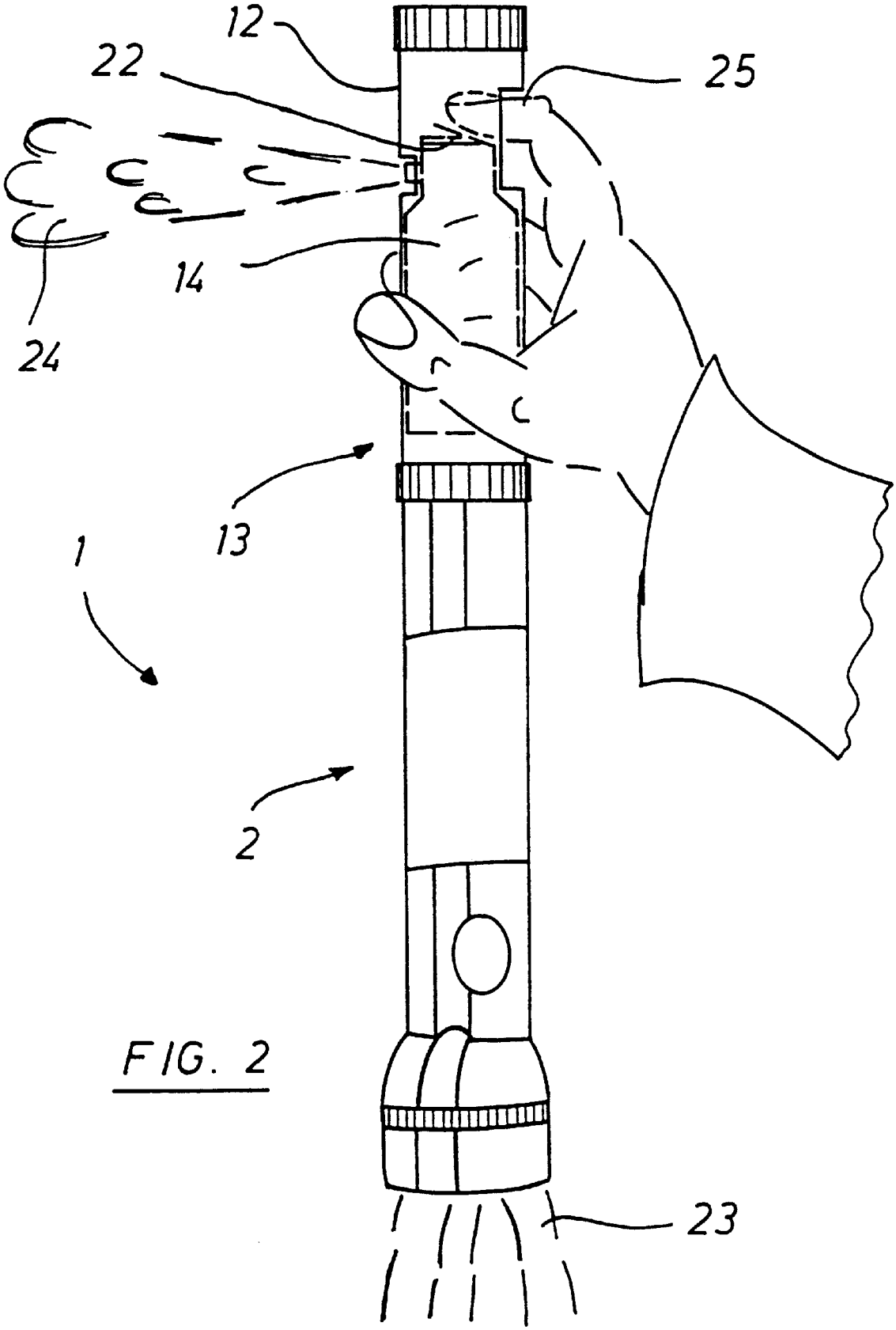
FIG. 2 shows the assembled device according to FIG. 1 in a first operational position and FIG. 3 shows the assembled device of FIG. 2 in a second operational position.

The device's manner of functioning when mounted together is described through FIG. 2 (according to the arrangement shown in FIG. 1): The light beam 23 is directed at the face of an attacker until he is within reach of the spray 24. The device is then pivoted by 90° so that the light beam points down. The blinding effect on the attacker thereby stops suddenly so that he opens his eyes wide as a natural reaction. Now the actuating element 22 of the spray can 14 is actuated with the index finger 25 (or alternatively with the thumb) which is introduced into the actuating opening 20, so that the spray 24 emerges in the direction of the face and wide open eyes of the attacker. Obviously the arrangement and design of the device overall complement and support each other here in order to obtain an optimal effect so as to render an attacker inoffensive.

As explained, the tubular part may also be mounted in a position which is offset by 180°. Actuation in this position is according to FIG. 3 so that the light beam 23 points up in that case. The other functions are as indicated in FIG. 2. In this manner an effective, manually operated self-defense device is provided.

I claim:

1. A combined flashlight and self-defense spray device comprising:

a) a first housing part comprising a battery operated, manual flashlight with two ends, one being a light emitting end and the other end being a connecting end;

b) a second housing part detachably connected to said first housing at the connecting end and having a compartment adapted to receive a spray can, said first and second housings having a common longitudinal axis;

c) said spray can compartment being provided with an actuating opening and a spray opening;

d) said actuating opening being positioned to allow the insertion of a finger to press the actuating button of the spray can; and, e) said spray opening being positioned to allow the spray nozzle to discharge the contents of the spray can therethrough in a direction perpendicular to the longitudinal axis of the housings.

2. The combined flashlight and spray device of claim 1 wherein the first and second housings are generally cylindrical in shape.

3. In a combined flashlight and self-defense device having a housing; a battery-operated light projector which can be manually turned on and off and which provides a predetermined direction of the light beam; an appertaining switch on the outside of the housing; a closable battery compartment in the housing; an arrangement for a manually operated spray device for the spraying of a self-defense spray with a spray nozzle pointed in a predetermined spraying direction to the outside of the housing; a closable spray can compartment in the housing, whereby the self-defense spray is contained under pressure in a spray can which can be inserted into the spray can compartment, the improvement comprising:

a) a light projector in the form of a cylindrical flash light housing located in a first housing part for directing light rays in the axial direction of the axis of the housing part, a light switch on the cylinder housing surface, and a cylindrical battery compartment within the housing for cylindrical batteries;

b) a second housing part in the form of a closing device for the first housing part located at the end of the first housing part opposite the reflector and connected to the first housing part in a removable manner;

c) a holder provided on said second housing to receive and attach a helicoidal spring pointing to the first housing part and acting as a compression spring which establishes the electrical mass connection in the electrical circuit of the light projector when the batteries are inserted into the battery compartment and the two housing parts are connected to each other; and, d) a spray can compartment within said second housing part for the insertion of a spray can having a nozzle, at least two openings to the exterior of said housing are provided with the first opening being a spray opening in the area of the spray nozzle, and a second opening serving as an actuating opening through which one reaches into the area of the actuating element of the spray can.

4. The combined flashlight and self-defense device of claim 3 wherein the second housing part is also cylindrical and has approximately the same diameter as the first housing part, so that an overall cylindrical housing is provided; and, wherein the spray opening and the actuating opening are on the cylinder sleeve surface, so that the direction of spray and the direction in which one reaches inside are approximately perpendicular tot he housing axis.

5. The combined flashlight and self-defense device of claim 3 wherein the spray opening and the actuating opening are substantially across from each other on the cylinder sleeve surface and are offset relative to the longitudinal center of the second housing, whereby the position of the spray can is selected to point with the spray can button according to the position of the openings with the spray can head.

6. The combined flashlight and self-defense device of claim 3 wherein the actuating opening will accommodate an index finger and wherein the spray opening is smaller in size than said actuating opening.

7. The combined flashlight and self-defense device of claim 3 wherein an irritating gas selected from the group consisting of a tear gas and a pepper spray is used as the self-defense gas.

8. The combined flashlight and self-defense device of claim 3 wherein the second housing part comprises a tubular part and an adapter part, said adapter part containing a holder with a helicoidal spring and said detachable connection to the first housing part is provided with a detachable connection to the tubular part.

9. The combined flashlight and self-defense device of claim 8 wherein the adapter part is cylindrical to match the other housing parts.

10. The combined flashlight and self-defense device of claim 3 wherein the free end of the second housing part is open and wherein the screw cap is provided for closing said free end and said cap has the same locking design as the connection to the first housing part, wherein the cap can be used with the helicoidal spring inserted on the first housing part when the two housing parts are separated.

11. The combined flashlight and self-defense device of claim 10 including a connection means between said adapter part and the tubular part and wherein said means is configured so that the tubular part can alternatively be mounted offset by 180°.

12. The combined flashlight and self-defense device of claim 3 wherein all the connections in said device are made with identical threads.

13. The combined flashlight and self-defense device of claim 3 including a replacement lamp contained in the interior of the helicoidal spring.

* * * * *